US005175071A

United States Patent [19]

Mychajlowskij et al.

[11] Patent Number: 5,175,071

[45] Date of Patent: Dec. 29, 1992

[54] ENCAPSULATED TONER COMPOSITION

[75] Inventors: Walter Mychajlowskij, Georgetown; Beng S. Ong, Mississauga; Barkev Keoshkerian, Thornhill; Guerino G. Sacripante, Cambridge, all of Canada

[73] Assignee: Xerox Corporation, Stamford, Conn.

[21] Appl. No.: 720,300

[22] Filed: Jun. 25, 1991

[51] Int. Cl.[5] ..... G03G 9/093

[52] U.S. Cl. ..... 430/138; 430/106; 430/109; 430/110

[58] Field of Search ..... 430/109, 45, 138, 110, 430/106, 109

[56] References Cited

U.S. PATENT DOCUMENTS

| | | | |
|---|---|---|---|
| 3,016,308 | 1/1962 | Macauley | 117/36.7 |
| 3,405,070 | 10/1968 | Reyes | 252/316 |
| 4,259,426 | 3/1981 | Hasegawa et al. | 430/98 |
| 4,520,091 | 5/1985 | Kakimi et al. | 430/110 |
| 4,524,199 | 6/1985 | Lok et al. | 527/313 |
| 4,576,890 | 3/1986 | Hosoi | 430/137 |
| 4,626,489 | 12/1986 | Hyosu | 430/137 |
| 4,652,508 | 3/1987 | Ober et al. | 430/109 |
| 4,727,011 | 2/1988 | Mahabadi et al. | 430/138 |
| 4,851,318 | 7/1989 | Hsieh et al. | 430/137 |
| 5,087,538 | 2/1992 | Nelson | 430/45 |

*Primary Examiner*—Roland Martin
*Assistant Examiner*—Rosemary Ashton
*Attorney, Agent, or Firm*—E. O. Palazzo

[57] ABSTRACT

A toner composition comprised of a core comprised of a polymer resin or resins, color pigment, dye, or mixtures thereof, and thereover a coating comprised of an alkyl cellulose.

23 Claims, No Drawings

ENCAPSULATED TONER COMPOSITION

BACKGROUND OF THE INVENTION

The present invention is generally directed to toner compositions and processes thereof, and more specifically to overcoated toner compositions and processes for directly generating toner compositions without resorting to the conventional pulverization and classification methods. In one embodiment, the present invention relates to toner compositions comprised of a core comprised of a polymer resin and colorants, including color pigments, dyes, or mixtures thereof, and an outer coating layer comprised of a cellulose component, such as methyl cellulose, hydroxypropyl cellulose, hydroxyethylmethyl cellulose, and the like, and wherein the cellulose layer functions primarily as a protective coating for the core components, especially during the preparation thereof. In addition, with the outer cellulose layer, the toners prepared by the processes of the present invention do not require in embodiments additional protective coatings for mechanical integrity, or for protection against the environment. In one embodiment, the present invention provides toner compositions wherein the outer cellulose coating has been chemically treated. The processes of the present invention do not utilize such toxic and undesirable reagents as polyisocyanates, polyacyl halides, and polyamines, which materials are often the shell precursors for many of the prior art encapsulated toner compositions. The processes of the present invention in embodiments thereof are comprised of an initial dispersion step for forming a stabilized organic microdroplet suspension in an aqueous medium containing a cellulose surfactant, such as hydroxyethylmethyl cellulose, methyl cellulose or the like; a physical overcoating step comprising precipitation of cellulose molecules around the microdroplets; and a final core resin formation step by free radical polymerization. The precipitation of cellulose molecules is believed to begin at the initial dispersion-stabilization stage, and continues during the core resin forming free radical polymerization step. In embodiments, the processes of the present invention can also utilize a combination of cellulose polymers and inorganic surfactants, such as potassium oleate, sodium dodecyl sulfate, and the like during the dispersion step. The cellulose-inorganic surfactant system facilitates efficient generation of very small sized microdroplets, particularly those with an average particle diameter of from about 2.5 microns to about 7 microns, together with a narrow particle size distribution of less than 1.35. The processes of the present invention therefore offer in embodiments simplicity, efficiency, the attributes of utilizing only nontoxic materials; and no post-reaction waste treatments are accordingly necessary. In contrast, a number of known encapsulated toners are comprised of condensation polymer shells prepared, for example, by interfacial polycondensation of toxic polyisocyanate, or polyacyl halides with polyamines or polyols, and costly post-reaction waste treatments are generally required for the preparation of these toner compositions.

The primary function of the cellulose coatings for the toner compositions prepared by the processes of the present invention is to provide stability to the particles during the core resin-forming preparation. The cellulose coatings in embodiments of the present invention also provide mechanical integrity to the toner compositions, and ensure effective containment and protection of the core components. In addition, the coatings also inhibit toner particles from coalescing and prevent, or minimize toner agglomeration. Another important function of the coatings relates to the nullification, or passivation of the triboelectric charging effects of colorants present in the toner compositions, such that the triboelectric charging characteristics of the toner compositions are primarily controlled or dominated by the charging effects of the cellulose layer, and surface additives. The processes of the present invention in embodiments accomplishes many of the objectives illustrated herein without utilizing the usual chemical shell-forming polycondensation reactions. Accordingly, the processes of the present invention are useful for the preparation of a wide variety of colored toners possessing similar or substantially similar triboelectric charging characteristics against a selected carrier, irrespective of the nature of the colorants present in the toners. For single component development where triboelectric charging is generally accomplished by a frictional charging blade, similar equilibrium triboelectric charge levels can also be obtained under identical conditions with different colored toners prepared by the processes of the present invention. Effective coverage of core components by the cellulose coating of the present invention also inhibits the diffusion of core components, thereby eliminating or substantially reducing the problem of toner blocking or agglomeration in toners wherein core resins of low glass transition temperatures are utilized. The cellulose coating for the toner compositions obtained by the processes of the present invention are in general relatively thin in nature, its presence therefore does not substantially affect the toner's fusing characteristics.

In color reprography, such as in full color or highlight color applications, colored toners with a wide variety of colors including black are usually employed. For two component development, it is highly desirable that the triboelectric properties of different colored toners be desirably controlled so that they all attain similar equilibrium triboelectric charging levels when utilized against a selected carrier. This is especially useful for custom colored toner packages, since colored toners with a wide variety of custom colors can be obtained by simple blending of the primary colored toners. Another important aspect for two component development is the rate of charging of the fresh toners to the equilibrium charge levels when they are added to the toner depleted development housing. A fast rate of charging of fresh toner can be important in ensuring proper image development, particularly for high speed reprographic systems.

It is known that color pigments or dyes present in the toner have a dominant effect on the toner's triboelectric charging behavior, arising primarily because these colorants are often also present at or close to the surface of the toner, and are, therefore, exposed to their environments. As a consequence, when the toner particles are admixed with carriers, the interactions of the exposed pigments of the toners with the carrier particles drastically affect the charging behavior of the toner. Similar effects are obtained for a number of prior art encapsulated toners where the color pigment particles are not completely encapsulated within the toner shell. Thus, it is often observed that toners with identical components, except colorants, exhibit different charging behavior, even to the extent of having triboelectric charges of opposite polarity. To overcome this difficulty, it is usually necessary to utilize different charge control additives for different colorants, or to use high levels of charge control additives so as to nullify or overcome the different charging effects of different colorants, and exert a dominating influence on the charging characteristics of the toners. The toners and processes of the present invention eliminate or overcome this difficulty through complete or substantially complete encapsulation of core components since the adsorption of cellulose polymers, and their subsequent precipitation occur on the surface of the microdroplets. As a consequence, the need to rely on different or high levels of charge control additives for different colored toners for achieving similar triboelectric charging levels is eliminated or substantially avoided. Other advantages associated with the toner compositions obtained by the processes of the present invention include, for example, rapid triboelectric charging rates, small toner size and narrow size distribution for high resolution images, excellent color mixing properties and image color fidelity, high image projection efficiency enabling their use on transparent substrates, lower fusing temperatures, acceptable powder flow, and nonblocking and nonagglomerating characteristics. The toner compositions of the present invention can be selected for a variety of known imaging processes including electrophotographic and ionographic processes. Preferably, the toner compositions are selected for electrophotographic processes wherein image fixing is accomplished by heat fusion.

Encapsulated toners and processes are known. For example, both U.S. Pat. No. 4,626,489 and British Patent 1,538,787 disclose similar processes for colored encapsulated toners wherein both the core resin and shell materials are prepared by suspension polymerization techniques. U.S. Pat. No. 4,565,764 discloses a colored microcapsule toner comprised of a colored core encapsulated by two resin shells with the inner shell having an affinity for both the core and the outer shell materials; U.S. Pat. No. 4,727,011 discloses a process for preparing encapsulated toners which involves a shell forming interfacial polycondensation and a core binder forming free radical polymerization; and U.S. Pat. No. 4,708,924 discloses the use of a mixture of two polymers, one having a glass transition temperature in the range of −90° C. to 5° C., and the other having a softening temperature in the range of 25° C. to 180° C., as the core binders for a pressure fixable encapsulated toner. Other representative United States patents are: U.S. Pat. No. 4,339,518, which relates to a process of electrostatic printing with fluorinated polymer toner additives where suitable materials for the dielectric toner are thermoplastic silicone resins and fluorine containing resins having low surface energy; U.S. Pat. No. 4,016,099, which discloses methods of forming encapsulated toner particles and wherein there are selected organic polymers including homopolymers and copolymers such as vinylidene fluoride, tetrafluoroethylene, chlorotrifluoroethylene, and the like; U.S. Pat. No. 4,497,885, which discloses a pressure fixable microcapsule toner comprising a pressure fixable component, a magnetic material, and other optional components, and wherein the core material can contain a soft material typical examples of which include polyvinylidenefluoride, polybutadiene, and the like; U.S. Pat. No. 4,520,091 discloses an encapsulated toner with a core which comprises a colorant, a dissolving solvent, a nondissolving liquid and a polymer, and may include additives such as fluorine containing resin; and U.S. Pat. No. 4,590,142 relating to capsule toners wherein additives such as polytetrafluoroethylenes are selected as lubricating components. Furthermore, there are disclosed in the prior art encapsulated toner compositions containing costly pigments and dyes, reference for example the color photocapsule toners of U.S. Pat. Nos. 4,399,209; 4,482,624; 4,483,912 and 4,397,483.

The following U.S. patents located in a patentability search report for encapsulated toners are mentioned: 3,967,962 which discloses a toner composition comprising a finely divided mixture comprising a colorant and a polymeric material which is a block or graft copolymer, including apparently copolymers of polyurethane and a polyether (column 6), reference for example the Abstract of the Disclosure, and also note the disclosure in columns 2 and 3, 6 and 7, particularly lines 13 and 35; however, it does not appear that encapsulated toners are disclosed in this patent; U.S. Pat. No. 4,565,764 which discloses a microcapsule toner with a colored core material coated successively with a first resin wall and a second resin wall, reference, for example, the Abstract of the Disclosure and also note columns 2 to 7, and particularly column 7, beginning at line 31, wherein the first wall may comprise polyvinyl alcohol resins known in the art, including polyurethanes, polyureas, and the like; U.S. Pat. No. 4,626,490 contains a similar teaching as the '764 patent and more specifically discloses an encapsulated toner comprising a binder of a mixture of a long chain organic compound and an ester of a higher alcohol and a higher carboxylic acid encapsulated within a thin shell, reference the Abstract of the Disclosure, for example, and note specifically examples of shell materials in column 8, beginning at line 64, and continuing on to column 9, line 17, which shells can be comprised, for example, of polyurethanes, polyurea, epoxy resin, polyether resins such as polyphenylene oxide or thioether resin, or mixtures thereof; U.S. Pat. Nos. 4,442,194 and 4,465,755, mentioned herein; and U.S. Pat. Nos. of background interest include 4,520,091; 4,590,142; 4,610,945; 4,642,281; 4,740,443 and 4,803,144.

Furthermore, other prior art, primarily of background interest, includes U.S. Pat. Nos. 4,254,201; 4,465,755 and Japanese Patent Publication 58-100857. The Japanese publication discloses a capsule toner with high mechanical strength, which is comprised of a core material including a display recording material, a binder, and an outer shell, which outer shell is preferably comprised of a polyurea resin. In the '201 patent, there are disclosed encapsulated electrostatographic toners wherein the shell material comprises at least one resin selected from polyurethane resins, a polyurea resin, or a polyamide resin. In addition, the '755 patent discloses a pressure fixable toner comprising encapsulated particles containing a curing agent, and wherein the shell is comprised of a polyurethane, a polyurea, or a polythiourethane. Moreover, in the '201 patent there are illustrated pressure sensitive adhesive toners comprised of clustered encapsulated porous particles, which toners are prepared by spray drying an aqueous dispersion of the granules containing an encapsulated material.

Also, in U.S. Pat. No. 4,599,271, the disclosure of which is totally incorporated herein by reference, there are illustrated microcapsules obtained by mixing organic materials in water emulsions at reaction parameters that permit the emulsified organic droplets of each emulsion to collide with one another, reference the disclosure in column 4, lines 5 to 35. Examples of polymeric shells are illustrated, for example, in column 5, beginning at line 40, and include isocyanate compounds such as toluene diisocyanate, and polymethylene polyphenyl isocyanates. Further, in column 6, at line 54, it is indicated that the microcapsules disclosed are not limited to use on carbonless copying systems; rather, the film material could comprise other components including xerographic toners, see column 6, line 54.

Illustrated in U.S. Pat. No. 4,758,506, the disclosure of which is totally incorporated herein by reference, are single component cold pressure fixable toner compositions, wherein the shell selected can be prepared by an interfacial polymerization process. Further in another U.S. Pat. No. 5,043,240 (D/89069), the disclosure of which is totally incorporated herein by reference, there are illustrated encapsulated toners with a core comprised of a polymer binder, pigment or dye, and thereover a polymeric shell, which contains a soft and flexible component, permitting, for example, proper packing of shell materials resulting in the formation of a high density shell structure, which can effectively contain the core binder and prevent its loss through diffusion and leaching process. The soft and flexible component in one embodiment is comprised of a polyether function. Specifically, in one embodiment there are disclosed in the aforementioned copending application encapsulated toners comprised of a core containing a polymer binder, pigment or dye particles, and thereover a shell preferably obtained by interfacial polymerization, which shell has incorporated therein a polyether structural moiety. Another specific embodiment of the copending application is directed to encapsulated toners comprised of a core of polymer binder, pigment, dye or mixtures thereof, and a polymeric shell of a polyether-incorporated polymer, such as a poly(ether urea), a poly(ether amide), a poly(ether ester), a poly(ether urethane), mixtures thereof, and the like.

Many of the prior art encapsulated toner compositions in particular colored toner compositions suffer from a number of deficiencies as indicated herein. For example, these toner compositions may not have the desirable fusing properties such as being able to be fused at reasonably low temperature of, for example, less than 160° C.; they generally possess very low transparency projection efficiency either because of a significant difference in the refractive indices of the shell and core components or because of a poor colorant dispersion within the core; they usually require different or excessive amounts of charge control agents for different colored toners; and their rates of triboelectic charging are poor. In addition, some prior art colored encapsulated toners cannot be obtained in smaller toner size of, for example, less than 7 or 8 microns with a narrow size distribution of, for example, less than about 1.35 in a cost effective manner. Also, toner blocking or agglomeration may be a problem with several of the prior art encapsulated toners because of the porosity of the shell structure, especially when they are exposed to conditions of elevated temperatures. Further, some of the prior art colored encapsulated toners are comprised of colored pigment particles that may not completely be encapsulated by the shell, and the triboelectric charging effects of such pigments are, therefore, not fully passivated, and this would adversely affect and degrade the toner triboelectric characteristics, thereby causing image quality to deteriorate. In addition, many of the prior art toner compositions do not possess the necessary long-term physical and environmental stability. These and other disadvantages are eliminated or substantially eliminated with the process and toner compositions of the present invention. More specifically, thus with the toners of the present invention, the toner properties can in many instances be tailored to certain specifications. Specifically, with the toners of the present invention in embodiments, complete or substantial passivation of the triboelectric charging effects of the colorants is accomplished, and smaller toner particle size with narrow size distribution can be achieved without conventional classification techniques. In addition, excellent transparency projection efficiency can be obtained with the toners of the present invention in embodiments since the cellulose layer is very thin. Also, the toners of the present invention do not block or agglomerate over a extended period of time, for example up to six months, in embodiments. In addition, the processes of the present invention avoid the use of the relatively toxic polyisocyanates, polyacyl halides, polyamines, and the like, which are often utilized in the prior art processes for encapsulated toner compositions. Accordingly, the processes of the present invention in many embodiments do not require the costly post reaction waste treatments.

SUMMARY OF THE INVENTION

It is a feature of the present invention to provide toner compositions with many of the advantages illustrated herein.

It is also a feature of the present invention to provide color toner compositions providing such desirable properties as excellent toner powder flow, and non-blocking characteristics, excellent color fidelity, excellent image transparency projection efficiency, resistance to vinyl offset, and excellent image permanence characteristics.

In another feature of the present invention there are provided toner compositions comprised of a core of polymer resin, colorants such as pigments, dyes, or mixtures thereof, and thereover a coating comprised of Tylose®, a hydroxyethylmethyl cellulose, a methyl cellulose, or the derivatives thereof.

Another feature of the present invention is the provision of toner compositions whose triboelectric properties are predominantly controlled by the outer cellulose layer, and the optionally added surface additives.

Further, in another feature of the present invention, there are provided color toners which exhibit similar equilibrium triboelectric properties against a selected carrier irrespective of the colorants present.

A related feature of the present invention is the provision of colored toner compositions whose triboelectric charging polarity can be desirably controlled or adjusted.

A still further related feature of the present invention is to provide colored toners which possess rapid rates of triboelectric charging when admixed with carrier particles.

Moreover, another feature of the present invention is the provision of colored toners exhibiting low temperature fusing properties.

A further feature of the present invention is to provide a simple process for the generation of small sized black and colored toners with narrow size distribution without the need to resort to conventional pulverization and classification techniques.

In a further feature of the present invention there are provided preparative processes for directly generating toner compositions comprised of a polymer resin or resins and colorants overcoated with a layer of a cellulose polymer, and wherein the triboelectric charging effects of the colorants are passivated or substantially passivated.

Another related feature of the present invention is the provision of a simple chemical preparation process for toner compositions wherein no toxic reagents are utilized.

These and other features of the present invention can be accomplished by the provision of toners, and, more specifically, toners with certain coatings thereover. In one embodiment of the present invention, there are provided toners with a core comprised of a polymer resin, colorants, such as pigment or dye, and thereover a coating comprised of a cellulose polymer, such as methyl cellulose, Tylose®, and the like, which coating has the ability to contain the core resin and colorants, and prevent, or minimize their loss through diffusion and leaching methods. The aforementioned outer coatings can also passivate or nullify the triboelectric charging effects of the colorants present in the toner compositions, thereby providing for the achievement of similar triboelectric properties for different colored toners. Specifically, in one embodiment there are provided in accordance with the present invention toners whose triboelectric charging properties are primarily controlled by the outer coating and the added surface additives. The toner compositions of the present invention in embodiments are comprised of a core containing a polymer resin, color pigment particles or dye molecules, and thereover an outer coating comprised of cellulose polymer, such as hydroxyethylmethyl cellulose, with an effective thickness of, for example, from about 0.0001 to about 0.5 micron. Another specific embodiment of the present invention is directed to color toners whose outer cellulose coatings have been removed or substantially removed or chemically modified so as to provide other specific properties.

The toner compositions of the present invention can be prepared by a simple one-pot process involving formation of stabilized particle suspension, followed by a core resin forming free radical polymerization within the particles. The process is comprised of, for example, (1) thoroughly mixing or blending a mixture of core resins monomers, optional preformed core resins, free radical initiators, and colorants; (2) dispersing the aforementioned well blended mixture by high shear blending to form stabilized microdroplets of specific droplet size and size distribution in an aqueous medium containing a suitable cellulose polymer, such as Tylose® and an optional inorganic surfactant, and wherein the volume average microdroplet diameter can be desirably adjusted to be from about 2 microns to about 30 microns with the volume average droplet size dispersity being less than 1.35 as inferred from the Coulter Counter measurements of the microcapsule particles after the cellulose polymer is precipitated on the microdroplets; precipitation of a cellulose polymer around microdroplets leading to the formation of cellulose-coated particles is believed to begin during the dispersion stage, and continue on thereafter; (3) effecting the free radical polymerization to form core resin by heating, forming the cellulose-coated polymer particles; and (4) processing the resulting particles by washing, drying and treating with known surface additives. The formation of stabilized particle suspension is generally conducted at ambient, about 25° C. in embodiments, temperature, while the free radical polymerization is carried out at a temperature from about 35° C. to about 120° C., and preferably from about 45° C. to about 90° C., for a period of from about 1 to about 24 hours depending primarily on the monomers and free radical initiators used. The core resin obtained via free radical polymerization, together with the optional preformed polymer resin, constitutes from about 75 to about 99 percent, and preferably in an amount of from about 85 to about 95 percent by weight of toner, the colorant constitutes from about 1 to about 15 percent by weight of toner, the cellulose coating constitutes from about 0.001 to about 5 percent by weight of toner, while the surface additives consisting of flow aids, surface release agents, and charge control chemicals constitute from about 0.1 to about 5 percent of toner in embodiments thereof.

Illustrative examples of core monomers, which are subsequently polymerized, include a number of known components such as acrylates, methacrylates, olefins including styrene and its derivatives such as methyl styrene, and the like. Specific examples of core monomers include methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, other substantially equivalent addition monomers, and known addition monomers, reference for example U.S. Pat. No. 4,298,672, the disclosure of which is totally incorporated herein by reference, and mixtures thereof. Illustrative examples of optional preformed core resins include styrene polymers, such as styrene-butadiene copolymers, PLIOLITES®, PLIOTONES®, polyesters, acrylate and methacrylate polymers, and the like.

Various known colorants may be selected for the toner compositions of the present invention providing, for example, that they do not substantially interfere with the free radical polymerization. Typical examples of specific colorants, preferably present in an effective amount of, for example, from about 3 to about 10 weight percent of toner include Paliogen Violet 5100 and 5890 (BASF), Normandy Magenta RD-2400 (Paul Uhlich), Permanent Violet VT2645 (Paul Uhlich), Heliogen Green L8730 (BASF), Argyle Green XP-111-S (Paul Uhlich), Brilliant Green Toner GR 0991 (Paul Uhlich), Lithol Scarlet D3700 (BASF), Toluidine Red (Aldrich), Scarlet for Thermoplast NSD Red (Aldrich), Lithol Rubine Toner (Paul Uhlich), Lithol Scarlet 4440, NBD 3700 (BASF), Bon Red C (Dominion Color), Royal Brilliant Red RD-8192 (Paul Uhlich), Oracet Pink RF (Ciba Geigy), Paliogen Red 3340 and 3871K (BASF), Lithol Fast Scarlet L4300 (BASF), Heliogen Blue D6840, D7080, K7090, K6902, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470

(BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlich), Paliogen Yellow 152 and 1560 (BASF), Lithol Fast Yellow 0991K (BASF), Paliotol Yellow 1840 (BASF), Novaperm Yellow FGL (Hoechst), Permanent Yellow YE 0305 (Paul Uhlich), Lumogen Yellow D0790 (BASF), Suco-Gelb L1250 (BASF), Suco-Yellow D1355 (BASF), Sico Fast Yellow D1165, D1355 and D1351 (BASF), Hostaperm Pink E (Hoechst), Fanal Pink D4830 (BASF), Cinquasia Magenta (DuPont), Paliogen Black L0084 (BASF), Pigment Black K801 (BASF) and carbon blacks such as REGAL 330® (Cabot), Carbon Black 5250 and 5750 (Columbian Chemicals), and the like.

Examples of the outer coating polymers selected for the toners and processes of the present invention include, alkyl celluloses, with the alkyl groups containing, for example, from 1 to about 10 carbon atoms; and more specifically methyl cellulose, ethyl cellulose, hydroxyethyl cellulose, hydroxypropyl cellulose, hydroxyethylmethyl cellulose, Tylose® and the like. The effective concentration of the cellulose polymer in the aqueous phase at the dispersion or microdroplet formation step is, for example, from about 0.1 percent by weight to about 5 percent by weight, with the preferred amount being determined primarily by the nature of the toner precursor materials and the desired toner particle size. In embodiments, inorganic surfactants are also utilized in combination with the cellulose polymer for achieving a smaller microdroplet size. Illustrative examples of suitable inorganic surfactants include alkali salts, such potassium oleate, potassium caprate, potassium stearate, sodium laurate, sodium dodecyl sulfate, sodium oleate, sodium laurate, and the like. The effective concentration of inorganic surfactant that is generally employed is for example from about 0.005 to about 0.5 percent by weight, and preferably from about 0.01 to about 0.10 percent by weight. Known surface additives such as silicas like AEROSIL R972®, metal oxides, such as tin oxide, in effective amounts such as about 0.5 to about 1 weight percent, and effective mixtures of the aforementioned additives can be utilized.

Illustrative examples of known free radical initiators that can be selected for the preparation of the toners include azo-type initiators such as 2-2'-azobis(dimethylvaleronitrile), azobis(isobutyronitrile), azobis(cyclohexanenitrile), azobis(methylbutyronitrile), mixtures thereof, and the like, peroxide initiators such as benzoyl peroxide, lauroyl peroxide, methyl ethyl ketone peroxide, isopropyl peroxycarbonate, 2,5-dimethyl2,5-bis(2-ethylhexanoylperoxy)hexane, di-tert-butyl peroxide, cumene hydroperoxide, dichlorobenzoyl peroxide, and mixtures thereof, with the effective quantity of initiator being, for example, from about 0.1 percent to about 10 percent by weight of that of core monomer.

For two component developers, carrier particles including steel ferrites, copper zinc ferrites, and the like, with or without coatings, can be admixed, from about 1 to about 3 parts of carrier for each 100 parts of carrier for example, with the encapsulated toners of the present invention, reference for example the carriers illustrated in U.S. Pat. Nos. 4,937,166; 4,935,326; 4,560,635; 4,298,672; 3,839,029; 3,847,604; 3,849,182; 3,914,181; 3,929,657 and 4,042,518, the disclosures of which are totally incorporated herein by reference.

The following examples are being submitted to further define various species of the present invention. These examples are intended to be illustrative only and are not intended to limit the scope of the present invention.

EXAMPLE I

A 6.8 micron (volume average particle diameter) cellulose-coated cyan toner was prepared as follows.

A mixture of 185.0 grams of isobutyl methacrylate, and 4.0 grams of Heliogen Blue K7090 (BASF) pigment was ball milled for 24 hours. To this mixture were added 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture was then transferred to a 2-liter reaction vessel containing 700 milliliters of a 1.0 percent aqueous Tylose® solution, and the resulting mixture was homogenized for 2 minutes using a Brinkmann polytron operating at 10,000 rpm. Thereafter, the mixture was mechanically stirred at room temperature, 25° C., for 30 minutes before heating to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner particle product evidenced a volume average particle diameter of 6.8 microns, and a particle size distribution of 1.31 according to Coulter Counter measurements.

Fifty (50.0) grams of the above prepared dried toner particles were dry blended with a mixture of 0.75 gram of AEROSIL R812® and 0.80 grams of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner displayed a triboelectric value of −17.5 microcoulombs per gram as determined in the known Faraday Cage apparatus. Also, it is believed that excellent images can be generated with the aforementioned developer, which images would possess acceptable resolution characteristics and wherein the latent images are initially formed in a xerographic experimental imaging device similar to the Xerox Corporation 9200 TM, and subsequent to the development of images with the aforementioned prepared toner the images can be transferred to a paper substrate and fixed with heat, about 160° C., with a Viton fuser roll.

EXAMPLE II

A 7.8 micron magenta cellulose-coated toner was prepared as follows.

A mixture of 85.0 grams each of n-butyl methacrylate and isobutyl methacrylate, and 5.5 grams of Fanal Pink D4830 pigment (BASF) was ball milled for 24 hours. To this mixture was added 4.5 grams of 2,2'-azobis-(isobutyronitrile), and the mixture was roll blended until all the aforementioned free radical initiator was dissolved. One hundred and fifty (150) grams of the resulting mixture were transferred to a 2-liter reaction vessel containing 700 milliliters of 1.0 percent aqueous Tylose ® solution, and was homogenized for 2 minutes using a Brinkmann polytron operating at 10,000 rpm. Thereafter, the mixture was mechanically stirred at room temperature for 30 minutes before heating to 80° C. over a period of 1 hour, and maintained at this temperature for another 10 hours. After cooling down to room temperature, the reaction product was washed repeatedly with water until the aqueous phase was clear, and the product was then freeze dried. The resulting toner product showed a volume average particle diameter of 7.8 microns, and a particle size distribution of 1.29 according to Coulter Counter measurement.

Fifty (50.0) grams of the dried toner product were dry blended with a mixture of 0.75 gram of AEROSIL R812 ® and 0.80 gram of conductive tin oxide powder for 10 minutes using a Greey blender with its blending impeller operating at 2,500 rpm. A negatively charged developer was prepared by blending 2 parts by weight of the dried toner particles with 98 parts by weight of the carrier particles of Example I. The toner displayed a triboelectric value of −20.1 microcoulombs per gram as determined in a Faraday Cage apparatus. When the aforementioned developer is incorporated into the xerographic imaging test fixture of Example I, it is believed that substantially similar results can be obtained.

EXAMPLE III

An 8.1 micron yellow cellulose-coated toner was prepared by the following procedure.

A mixture of 140.0 grams of isobutyl methacrylate, 30.0 grams of poly(n-butyl methacrylate), 8.0 grams of Sico Fast Yellow D1165 pigment (BASF), and 20 milliliters of methylene chloride was ball milled for 24 hours. To this mixture were added 4.5 grams of 2,2'-azobis-(isobutyronitrile), and the mixture was roll blended until all the free radical initiator was dissolved. One hundred and seventy (170) grams of the resulting mixture were transferred to a 2-liter reaction vessel containing 700 milliliters of 1.0 percent aqueous Tylose ® solution, and was homogenized for 2 minutes using a Brinkmann polytron operating at 10,000 rpm. Thereafter, the mixture was mechanically stirred at room temperature for 30 minutes before heating to 80° C. over a period of 1 hour, and maintained at this temperature for another 10 hours. After cooling down to room temperature, the reaction product was washed repeatedly with water until the aqueous phase was clear, and the product was then freeze dried. The resulting toner product showed a volume average particle diameter of 8.1 microns, and a particle size distribution of 1.26 according to Coulter Counter measurements.

Fifty (50.0) grams of the dried toner particles were dry blended with 0.75 gram of AEROSIL R812 ® and 0.80 gram of conductive tin oxide powder, and a negatively charged developer was prepared by repeating the procedure of Example I. The toner displayed a triboelectric value of −18.8 microcoulombs per gram.

EXAMPLE IV

A 6.8 micron red cellulose-coated toner was prepared by the following procedure.

A toner was prepared in accordance with the procedure of Example I except that a mixture of 150.0 grams of isobutyl methacrylate, 20.0 grams of styrene, and 7.5 grams of Lithol Scarlet NBD 3700 pigment (BASF) was utilized in place of a mixture of 185.0 grams of isobutyl methacrylate, and 4.0 grams of Heliogen Blue K7090 pigment. The resulting toner product evidenced a volume average particle diameter of 6.8 microns, and a particle size distribution of 1.36. Fifty (50.0) grams of the prepared dried toner particles were dry blended with a mixture of 0.75 gram of AEROSIL R812 ® and 0.80 gram of conductive tin oxide powder for 10 minutes using a Greey blender with its blending impeller operating at 2,500 rpm. The dried toner particles were dry blended, and a negatively charged developer was prepared subsequently, both in accordance with the procedure of Example I. The toner exhibited a triboelectric value of 19.1 microcoulombs per gram.

EXAMPLE V

An 8.0 micron blue cellulose-coated toner was prepared by the following procedure.

The toner was prepared in accordance with the procedure of Example II except that 4.0 grams of PV Fast Blue B2G01 pigment (American Hoechst) were utilized instead of Fanal Pink D4830 pigment. The resulting toner product evidenced a volume average particle diameter of 8.0 microns with a particle size distribution of 1.28. The dried toner particles were dry blended, and a negatively charged developer was prepared subsequently, both in accordance with the procedure of Example I. The toner exhibited a triboelectric value of −18.5 microcoulombs per gram.

EXAMPLE VI

A 5.1 micron cellulose-coated cyan toner was prepared by the following procedure.

The toner was prepared in accordance with the procedure of Example I except that a mixture of 140.0 grams of n-butyl methacrylate, 60.0 grams of styrene, and 3.6 grams of Heliogen Blue K7090 pigment (BASF) was utilized in place of a mixture of 185 grams of isobutyl methacrylate, and 5.0 grams of Heliogen Blue K7090 pigment. In addition, 700 milliliters of water containing 7.0 grams of Tylose ® and 0.70 gram of sodium dodecyl sulfate were used in place of the 700 milliliters of 1.0 percent of the aqueous Tylose ® solution. The resulting encapsulated toner product evidenced a volume average particle diameter of 5.1 microns, and a particle size distribution of 1.26. The dried toner particles were dry blended, and a negatively charged developer was prepared subsequently, both in accordance with the procedure of Example I. The toner exhibited a triboelectric value of −18.1 microcoulombs per gram.

EXAMPLE VII

A 3.5 micron cellulose-coated cyan toner was prepared by the following procedure.

The toner was prepared in accordance with the procedure of Example I except that a mixture of 140.0 grams of n-butyl methacrylate, 60.0 grams of styrene, and 3.6 grams of Heliogen Blue K7090 pigment was utilized in place of a mixture of 185 grams of isobutyl methacrylate, and 5.0 grams of Heliogen Blue K7090 pigment. In addition, 700 milliliters of water containing 7.0 grams of Tylose ® and 1.0 gram of sodium dodecyl sulfate were used in place of 700 milliliters of 1.0 percent of the aqueous Tylose ® solution. The resulting encapsulated toner product evidenced a volume average particle diameter of 3.5 microns, and a particle size distribution of 1.31. The dried toner particles were dry blended, and a negatively charged developer was prepared subsequently, both in accordance with the procedure of Example I. The toner exhibited a triboelectric value of −19.6 microcoulombs per gram.

When the developers of Examples III, IV, V, VI and VII are incorporated into the xerographic imaging test fixture of Example I, it is believed that substantially similar results can be obtained.

Other modifications of the present invention may occur to those skilled in the art subsequent to a review of the present application, and these modifications, including equivalents thereof, are intended to be included within the scope of the present invention.

What is claimed is:

1. An encapsulated toner composition consisting essentially of a core consisting essentially of a polymer resin or resins, color pigment, dye, or mixtures thereof, which core excludes a cellulose component, and thereover a continuous encapsulant coating comprised of an alkyl cellulose; and wherein the coating contains a mixture consisting essentially of an inorganic surfactant selected from the group consisting of potassium oleate, potassium caprate, potassium stearate, sodium laurate, sodium dodecyl sulfate, sodium oleate, and sodium laurate, a colloidal silica and conductive metal oxide powders; and wherein the average particle diameter of the resulting encapsulated toner is from 3 to 7 microns.

2. A toner in accordance with claim 1 wherein the alkyl cellulose is hydroxyethylmethyl cellulose.

3. A toner in accordance with claim 1 wherein the alkyl cellulose is hydroxypropyl cellulose.

4. A toner in accordance with claim 1 wherein the alkyl cellulose is methyl cellulose.

5. A toner in accordance with claim 1 wherein the coating is of a thickness of from about 0.0001 to about 0.5 micron.

6. A toner in accordance with claim 1 wherein the coating is of a thickness of from about 0.001 to about 0.1 micron.

7. A toner in accordance with claim 1 wherein the alkyl cellulose coating forms a continuous layer on the toner surface.

8. A toner in accordance with claim 7 wherein the toner resin polymer is selected from the group consisting of acrylate copolymers, methacrylate copolymers, styrene, and styrene copolymers.

9. A toner in accordance with claim 1 wherein the polymer resin is an acrylate polymer, a methacrylate polymer, or a styrene polymer.

10. A toner in accordance with claim 1 wherein the polymer resin is selected from the group consisting of acrylate copolymers, methacrylate copolymers, styrene, and styrene copolymers.

11. A toner in accordance with claim 1 wherein the polymer resin is a poly(butyl methacrylate).

12. A toner in accordance with claim 1 wherein the polymer resin is a styrene-acrylate copolymer.

13. A toner in accordance with claim 1 wherein the polymer resin is a styrene-methacrylate copolymer.

14. A toner in accordance with claim 1 wherein the polymer resin is derived from polymerization of addition monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes.

15. A toner in accordance with claim 1 wherein the pigment is carbon black, magnetite, or mixtures thereof.

16. A toner in accordance with claim 1 wherein the pigment is cyan, yellow, magenta, red, green, blue, brown, or mixtures thereof.

17. A toner in accordance with claim 1 wherein the surface additives are present in an amount of from about 0.1 to about 5 weight percent.

18. An imaging process which comprises the generation of an image on an imaging surface, subsequently developing this image with the toner composition of claim 1, thereafter transferring the image to a suitable substrate, and permanently affixing the image thereto.

19. An imaging method in accordance with claim 18 wherein fixing is accomplished by heat.

20. An imaging method in accordance with claim 18 wherein fixing is accomplished by a combination of pressure and heat.

21. A toner composition in accordance with claim 1 wherein the thickness of the cellulose coating is from about 0.0001 to about 0.5 micron.

22. A toner composition in accordance with claim 1 wherein the thickness of the cellulose coating is from about 0.001 to about 0.1 micron.

23. A toner in accordance with claim 1 wherein the coating is comprised of said alkyl cellulose and a surfactant of sodium dodecyl sulfate.

* * * * *